US008991526B2

(12) United States Patent
Gillis

(10) Patent No.: US 8,991,526 B2
(45) Date of Patent: Mar. 31, 2015

(54) DRILL BIT

(75) Inventor: Sean Gillis, Beaumont (CA)

(73) Assignee: Drilformance Technologies, LLC, Houston, TX (US)

( * ) Notice: Subject to any disclaimer, the term of this patent is extended or adjusted under 35 U.S.C. 154(b) by 621 days.

(21) Appl. No.: 13/143,814

(22) PCT Filed: Jan. 25, 2010

(86) PCT No.: PCT/CA2010/000105

§ 371 (c)(1),
(2), (4) Date: Jul. 8, 2011

(87) PCT Pub. No.: WO2010/085880

PCT Pub. Date: Aug. 5, 2010

(65) Prior Publication Data

US 2011/0278073 A1 Nov. 17, 2011

Related U.S. Application Data

(60) Provisional application No. 61/148,501, filed on Jan. 30, 2009.

(51) Int. Cl.
*E21B 10/43* (2006.01)

(52) U.S. Cl.
CPC ..... *E21B 10/43* (2013.01)
USPC ..... 175/431; 175/426

(58) Field of Classification Search
USPC ..... 175/426, 431, 327
See application file for complete search history.

(56) References Cited

U.S. PATENT DOCUMENTS

| | | | | |
|---|---|---|---|---|
| 4,352,399 | A | 10/1982 | Davis | |
| 4,471,845 | A * | 9/1984 | Jurgens | 175/431 |
| 4,907,662 | A | 3/1990 | Deane et al. | |
| 5,346,025 | A | 9/1994 | Keith et al. | |
| 5,351,772 | A | 10/1994 | Smith | |
| 5,460,233 | A | 10/1995 | Meany et al. | |

(Continued)

FOREIGN PATENT DOCUMENTS

| | | |
|---|---|---|
| CA | 2423099 | 3/2002 |
| CA | 2445301 | 10/2003 |

(Continued)

OTHER PUBLICATIONS

Menand, Stephane et. al., "PDC bit technology improvements increase efficiency, bit life", Drilling Contractor, Mar./Apr. 2005, pp. 52-54.

*Primary Examiner* — Brad Harcourt
(74) *Attorney, Agent, or Firm* — Terrence N. Kuharchuk; Rodman & Rodman

(57) ABSTRACT

A fixed cutter drill bit having a bit axis and a gauge diameter. The drill bit includes a bit body having a proximal end, a distal end, and a plurality of blades extending from the distal end toward the proximal end. The blades define a cutting profile between the bit axis and the gauge diameter. The drill bit further includes a plurality of cutters attached to the blades in a cutter layout. The cutter layout may include a balanced cutter pattern extending from the bit axis toward the gauge diameter. The cutter layout may include one or more sets of shared cutters, wherein each set of shared cutters includes a trailing shared cutter and a leading shared cutter. The blades may define pairs of makeup surfaces and breaker surfaces. The drill bit may include a breaker upset for engaging with a device for supporting the drill bit.

33 Claims, 5 Drawing Sheets

(56) References Cited

U.S. PATENT DOCUMENTS

| | | | | |
|---|---|---|---|---|
| 5,595,252 | A * | 1/1997 | O'Hanlon | 175/57 |
| 5,601,477 | A | 2/1997 | Bunting et al. | |
| 6,006,846 | A | 12/1999 | Tibbitts et al. | |
| 6,283,233 | B1 | 9/2001 | Lamine et al. | |
| 6,311,789 | B1 | 11/2001 | Saxman | |
| 6,601,662 | B2 | 8/2003 | Matthias et al. | |
| 6,861,098 | B2 | 3/2005 | Griffin et al. | |
| 6,861,137 | B2 | 3/2005 | Griffin et al. | |
| 6,878,447 | B2 | 4/2005 | Griffin et al. | |
| 6,935,444 | B2 | 8/2005 | Lund et al. | |
| 7,188,692 | B2 | 3/2007 | Lund et al. | |
| 7,457,734 | B2 | 11/2008 | Johnson et al. | |
| 7,475,744 | B2 | 1/2009 | Pope | |
| 7,712,553 | B2 | 5/2010 | Shamburger | |
| 7,896,106 | B2 * | 3/2011 | Gavia | 175/57 |
| 2004/0112650 | A1 | 6/2004 | Moseley | |
| 2006/0070771 | A1 | 4/2006 | McClain et al. | |
| 2007/0079995 | A1 | 4/2007 | McClain et al. | |
| 2007/0199739 | A1 | 8/2007 | Schwefe et al. | |
| 2008/0135297 | A1 | 6/2008 | Gavia | |
| 2008/0149393 | A1 | 6/2008 | McClain et al. | |
| 2008/0179106 | A1 | 7/2008 | Gavia et al. | |
| 2008/0179107 | A1 | 7/2008 | Doster | |
| 2008/0179108 | A1 | 7/2008 | McClain et al. | |
| 2008/0308320 | A1 | 12/2008 | Kolachalam | |

FOREIGN PATENT DOCUMENTS

| | | |
|---|---|---|
| CA | 2524106 | 4/2006 |
| CA | 2423102 | 8/2009 |
| CA | 2379806 | 11/2009 |
| WO | 2008095005 A1 | 8/2008 |

* cited by examiner

FIG. 5
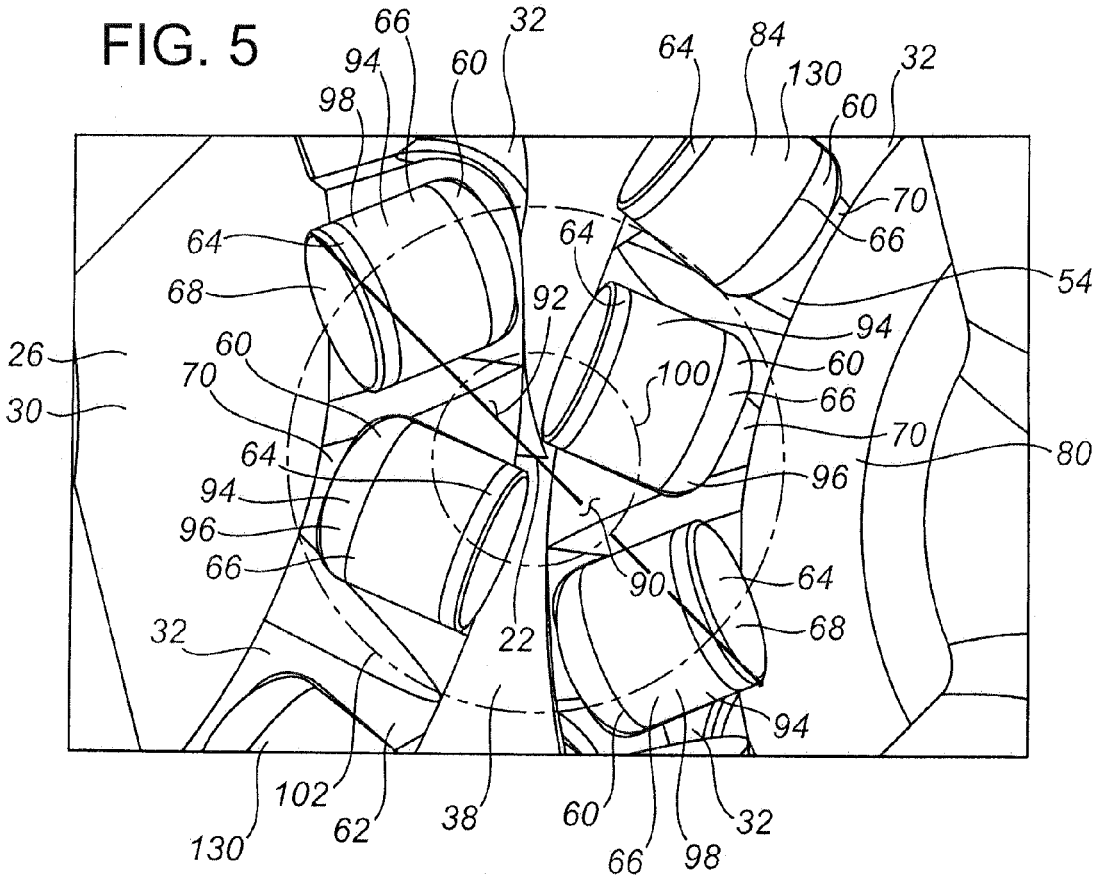
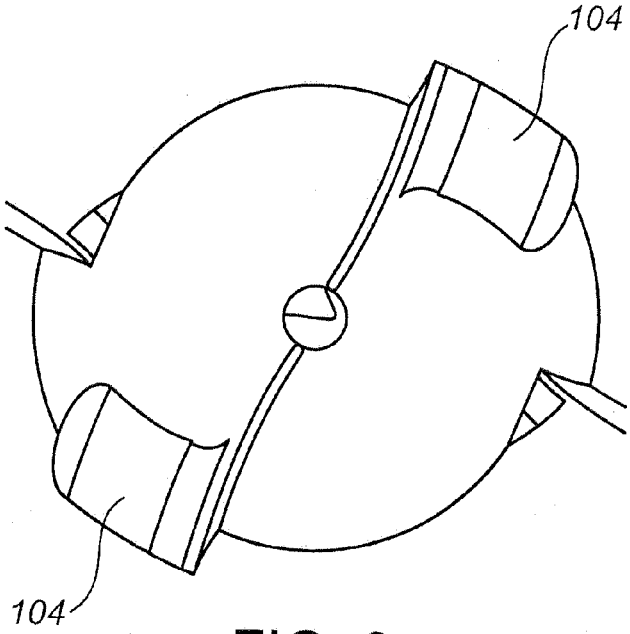
FIG. 6

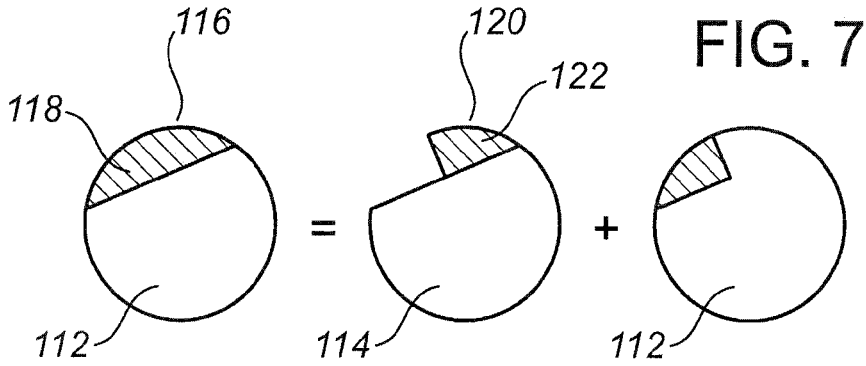
FIG. 7
FIG. 8
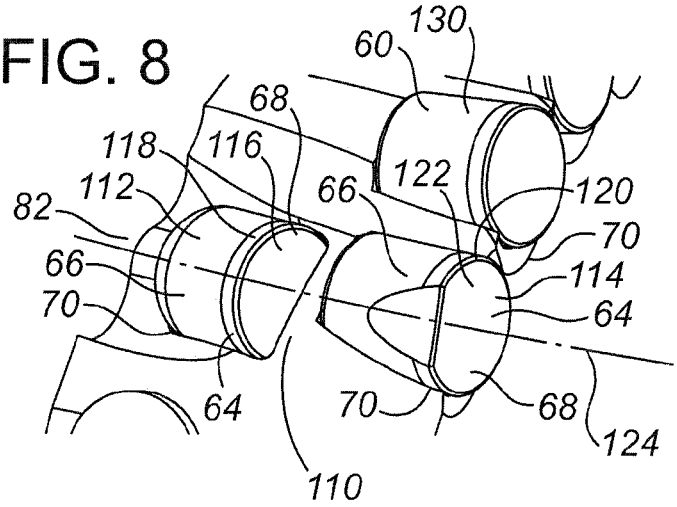
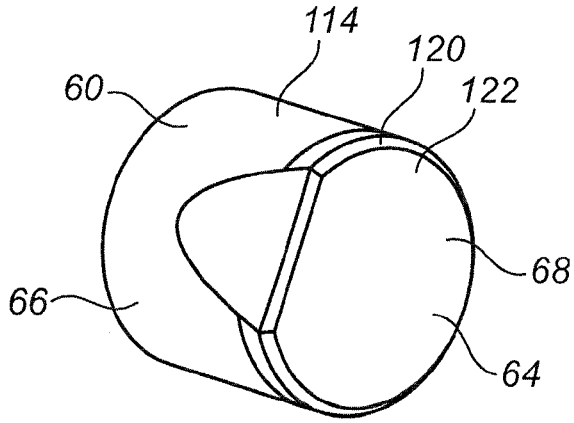
FIG. 9

DRILL BIT

TECHNICAL FIELD

A fixed cutter drill bit and configurations for a fixed cutter drill bit.

BACKGROUND OF THE INVENTION

A borehole is typically drilled using a drill bit which is attached to an end of a drill string. Rotary drilling is performed by rotating the drill bit. The drill bit may be rotated by rotating the drill string, by rotating the drill bit with a downhole drilling motor, or in some other manner.

A roller cone drill bit includes cones which rotate as the drill bit is rotated. Teeth which are positioned on the cones roll along the bottom of the borehole as the cones rotate. The teeth impact the bottom of the borehole as they roll and thereby crush and disintegrate rock in order to advance the borehole.

A fixed cutter drill bit typically includes no moving parts, but includes cutters which are attached to the body of the drill bit and which rotate with the drill bit as the drill bit is rotated. The cutters scrape the borehole as the drill bit rotates, thereby shearing rock in order to advance the borehole.

A cutter on a fixed cutter drill bit is typically comprised of a cutter element, such as an "abrasive" or "superabrasive" cutter element, which performs the shearing action. An abrasive cutter element may be comprised of tungsten carbide, another carbide material, ceramic and/or some other material. A superabrasive cutter element may be comprised of natural diamond, a synthetic diamond material such as polycrystalline diamond compact (PDC) or thermally stable diamond (TSP), or may be comprised of some other material such as cubic boron compact or diamond grit impregnated substances.

A cutter on a fixed cutter drill bit may be further comprised of a substrate to which the cutter element may be affixed. For example, a PDC or TSP cutter element may be comprised of a disc or cylinder shaped "diamond table" which may be affixed to a substrate such as tungsten carbide in order to provide the complete cutter. The diamond table typically comprises a substantially flat and circular cutting face which contacts the borehole in order to perform the shearing action.

A PDC or TSP cutter element may typically be affixed to a substrate by applying high temperature and high pressure to the cutter element and substrate in the presence of a catalyst so that the materials of the cutter element and the substrate bond with each other.

Fixed cutter drill bits are therefore typically comprised of a bit body and a plurality of cutters which are attached to the bit body. The bit body is typically constructed of steel or of a matrix containing an erosion resistant material such as tungsten carbide. The cutters are typically attached to the bit body by an adhesive or by brazing. The cutters may be received in cutter pockets in the bit body in order to facilitate the attachment of the cutters to the bit body.

The bit body and the cutters are configured to provide an overall design for the drill bit, having regard to considerations such as rate of penetration of the drill bit, drill bit stability, drill bit steerability, drill bit durability and hydraulic performance of the drill bit.

For example, the bit body typically includes a plurality of blades to which the cutters are attached and between which fluids and cuttings may pass. Because the cutters are typically attached to the blades of the drill bit, increasing the number of blades on a fixed cutter drill bit will generally increase the number of cutters which may be attached to the bit body, thereby increasing the "cutter count" and the "cutter density" on the drill bit.

Generally, the rate of penetration which can be achieved by a fixed cutter drill bit is inversely proportional to the number of blades and cutters which are included in the drill bit. In other words, the greater the number of blades and the greater the number of cutters, the lower the rate of penetration which may be expected from the drill bit.

Generally, the durability of the drill bit is proportional to the number of blades and cutters which are included in the drill bit. In other words, the greater the number of blades and the greater the number of cutters, the longer the drill bit may be expected to function without experiencing excessive wear.

Generally, the hydraulic performance of the drill bit is inversely proportional to the number of blades which are included in the drill bit. In other words, the greater the number of blades, the less area which is available between the blades for the passage of fluids and cuttings, and the more resistance which is provided to the passage of fluids and cuttings past the drill bit.

As a result, the design of a fixed cutter drill bit typically represents a compromise amongst the rate of penetration, stability, steerability, durability, and hydraulic performance which can be achieved with the drill bit. Various design strategies have been proposed for achieving an appropriate balance of these considerations.

U.S. Pat. No. 6,283,233 (Lamine et al) describes a drilling and/or coring tool which includes PDC cutting elements and/or secondary cutting elements and at least one associated cutting element which is situated behind at least one of the PDC or secondary cutting elements, wherein the associated cutting element is "hidden" behind the PDC or secondary cutting element and is unused unless or until the PDC or secondary cutting element with which it is associated wears down, is torn away, or is broken.

U.S. Pat. App. Pub. No. US 2006/0070771 A1 (McClain et al), U.S. Pat. App. Pub. No. US 2007/0079995 A1 (McClain et al), and U.S. Pat. App. Pub. No. US 2008/0149393 A1 (McClain et al) all describe a drill bit for drilling through a casing bit which is disposed at the end of a casing. The drill bit includes a first type of cutting element and a second type of cutting element. The first type of cutting element is comprised of a superabrasive material and the second type of cutting element may be comprised of either a superabrasive material or an abrasive material. The second type of cutting element is positioned behind the first type of cutting element but exhibits a "relatively greater exposure" than the first type of cutting element so as to engage the interior of the casing bit and drill through the casing bit. The second type of cutting element then wears quickly upon engagement with the subterranean formation, after which the first type of cutting element continues to drill through the subterranean formation.

U.S. Pat. App. Pub. No. US 2007/0199739 A1 (Schwefe et al) describes a cutter insert for a fixed cutter drill bit which may be used to secure a backup cutter in a recess behind a primary cutter on the drill bit. The backup cutter may be configured to be underexposed, overexposed or to have a substantially equal exposure relative to the primary cutter.

U.S. Pat. App. Pub. No. US 2008/0179106 A1 (Gavia et al) and U.S. Pat. App. Pub. No. US 2008/0179108 A1 (McClain et al) both describe a rotary drag bit which includes a primary cutter and at least two additional cutters which are positioned on a single blade of the drill bit and which are configured relative to each other. In particular, the additional cutters are configured to follow the primary cutter.

U.S. Pat. App. Pub. No. US 2008/0179107 A1 (Doster) describes a rotary drag bit which includes a plurality of blades and at least one split cutter set. The split cutter set includes a plurality of cutters, where at least two of the cutters are primary and/or kerfing cutters located on different blades of the bit, and where at least one of the cutters is a backup cutter. The cutters in the split cutter set all follow substantially a common cutting path upon rotation of the bit body about its central axis.

PCT International Publication No. WO 2008/095005 A1 (Chen et al) describes a rotary drill bit with cutting elements which are operable to control the depth of cut and rate of penetration during drilling of a wellbore. The cutting elements may be arranged in sets of a primary cutting element and an associated secondary cutting element, wherein the secondary cutting element is disposed in a leading position relative to the primary cutting element, and wherein the cutting face of the primary cutting element is exposed a greater distance from the bit face profile than the cutting face of the secondary cutting element. The sets of cutting elements may also be comprised of a "protector" which is operable to control the depth of the cut of the cutting elements.

There remains a need for fixed cutter drill bits which facilitate reasonable compromises with respect to the rate of penetration, stability, steerability, durability, and hydraulic performance which can be achieved with the drill bit.

SUMMARY OF THE INVENTION

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

The present invention relates to a fixed cutter drill bit and to features of a fixed cutter drill bit.

As contemplated herein, a "fixed cutter drill bit" is distinguished from a roller cone drill bit in that a fixed cutter drill bit typically includes no moving parts, but comprises a bit body and a plurality of cutters which are attached to the bit body.

The cutters rotate with the drill bit as the drill bit is rotated and scrape the borehole as the drill bit rotates, thereby shearing rock in order to advance the borehole. The cutters may be constructed of any suitable material or combination of materials.

The cutters are comprised of cutter elements which perform the shearing action.

In some embodiments, a cutter element may be an "abrasive" cutter element or a "superabrasive" cutter element. In some embodiments, an abrasive cutter element may be comprised of tungsten carbide, another carbide material, ceramic and/or some other material. In some embodiments, a superabrasive cutter element may be comprised of natural diamond, a synthetic diamond material such as polycrystalline diamond compact (PDC) or thermally stable diamond (TSP), or may be comprised of some other material such as cubic boron compact or diamond grit impregnated substances.

In some embodiments, the cutters may be further comprised of substrates to which the cutter elements may be affixed. The substrates may be comprised of any suitable material or combination of materials.

For example, in some embodiments a PDC or TSP cutter element may be comprised of a disc or cylinder shaped "diamond table" which may be affixed to a substrate such as tungsten carbide in order to provide a complete cutter. The cutter element may comprise a substantially flat and circular cutting face which contacts the borehole in order to perform the shearing action.

A cutter element may be affixed to a substrate in any suitable manner. In some embodiments, a PDC or TSP cutter element may be affixed to a substrate by applying high temperature and high pressure to the cutter element and the substrate in the presence of a catalyst so that the materials of the cutter element and the substrate bond with each other.

The bit body may be constructed of any suitable material or combination of materials. In some embodiments, the bit body may be constructed of steel or of a matrix. A matrix may contain an erosion resistant material. The erosion resistant material may be comprised of tungsten carbide, so that in some embodiments, the bit body may be considered to be constructed of a tungsten carbide matrix.

The bit body may be constructed as a single piece or the bit body may be comprised of a plurality of components which are connected together to provide the bit body. Components of the bit body may be constructed of the same material or of different materials.

The bit body and/or components of a bit body may be formed in any suitable manner. In some embodiments, the bit body and/or components thereof may be cast. In some embodiments, the bit body and/or components thereof may be milled.

The cutters may be attached to the bit body in any suitable manner. In some embodiments, the cutters may be attached to the bit body with an adhesive. In some embodiments, the cutters may be attached to the bit body by brazing. In embodiments in which the cutters are comprised of substrates, the cutters may be attached to the bit body by attaching the substrates of the cutters to the bit body.

In some embodiments, the bit body may define cutter pockets and the cutters may be received in the cutter pockets for attachment with the bit body.

The drill bit has a bit axis. The bit axis may be defined by the bit body. The drill bit has a gauge diameter. The gauge diameter represents a nominal diameter of the borehole which is drilled using the drill bit.

The bit body has a proximal end which is adapted for connecting with a drill string and the bit body has a distal end.

In some embodiments, the proximal end of the bit body may be comprised of a threaded connector for connecting the drill bit with the drill string. As contemplated herein, a "drill string" includes pipe, tubing and/or any other tool, coupling or connector which may be included in an assembly of components which may be referred to as a drill string.

In some embodiments, the proximal end of the bit body may be comprised of a pin type connector for engaging with a box type connector associated with the drill string. In some embodiments, the proximal end of the bit body may be comprised of a box type connector for engaging with a pin type connector associated with the drill string.

In some embodiments, the bit body may be comprised of a plurality of blades which extend from the distal end of the bit body toward the proximal end of the bit body. In some embodiments, the blades may be comprised of spiral blades.

The bit body may be comprised of any suitable number of blades. In some embodiments, the bit body may be comprised of between about three blades and about six blades.

In some embodiments, the blades may define a cutting profile between the bit axis and the gauge diameter. The cutting profile represents the portion of the bit which is presented to the bottom of a borehole in order to drill the borehole and the cutting profile defines the overall shape of the bottom of the borehole.

In some embodiments, the cutting profile may be designed having regard to a number of considerations relating to the performance of the drill bit, including but not limited to rate of penetration of the drill bit, drill bit stability, drill bit steerability, drill bit durability, and hydraulic performance of the drill bit.

The cutters may be attached to the bit body at any suitable location or locations on the bit body. The cutters are positioned and oriented on the bit body so that the cutting faces of the cutter elements may engage the borehole and thus provide cutting paths for the cutters as the drill bit rotates.

As a first example, the cutters are positioned on the bit body so that the cutting faces of the cutters exhibit an "exposure". The "exposure" of a cutting face is the extent to which the cutting face protrudes from the bit body so that it is capable of engaging the borehole and thus providing the cutting path. The peripheral edge of the portion of the cutting face which exhibits the exposure provides a "cutting edge", which defines the peripheral limit of the cutting path of the cutter. The cutting edge of a cutter is typically provided with a chamfer to provide improved durability and impact resistance of the cutter.

As a second example, the cutters may be oriented on the bit body so that the cutting faces of the cutters are perpendicular to the direction of rotation as they engage the borehole, or the cutting faces may be oriented to provide a "siderake angle" and/or a "backrake angle" relative to the direction of rotation. A "siderake angle" of a cutting face is the angle of the cutting face relative to the plane of rotation of the cutting face. A "backrake angle" of a cutting face is the angle of inclination of the cutting face within the plane of rotation of the drill bit.

As a third example, the cutters may be oriented on the bit body so that the cutting faces of the cutters provide a desired amount of "offset" relative to each other. The "offset" of cutting faces is the extent to which cutting faces are radially spaced from each other. Two cutting faces provide no offset if they completely overlap radially as the drill bit rotates. Two cutting faces provide a complete offset if they do not overlap at all radially as the drill bit rotates.

The cutting edge and the cutting path of an individual cutter is dependent upon factors such as the shape and size of the cutter and the exposure of the cutter. The effective cutting edge and the effective cutting path of an individual cutter in a set of cutters is further dependent upon the offset and the relative exposures of the cutters, since a leading cutter may partially or fully cover or project upon the cutting edge and the cutting path of a trailing cutter.

In some embodiments, a plurality of cutters may be attached to the blades. In some embodiments in which a plurality of cutters is attached to the blades, cutters may also be attached to the bit body at locations other than the blades.

In some embodiments, a plurality of cutters may be distributed on the blades in a cutter layout along the cutting profile. The cutter layout determines the contribution which each cutter makes to the drilling of the borehole as the drill bit is rotated in the borehole. The contribution which each cutter makes to the drilling of the borehole is dependent upon a number of variables, including but not limited to cutter shape, cutter size, cutter count, cutter density, cutter siderake angle, cutter backrake angle, cutter exposure, and cutter offset.

The cutters may be positioned on the bit body in the cutter layout in any suitable manner. In some embodiments, the cutters may be positioned in the cutter layout by making suitable measurements before attaching the cutters to the bit body. In some embodiments, the cutters, the bit body and/or the cutter pockets may be provided with guides such as shaped holes or lugs so that the cutters may be positioned at a desired orientation on the bit body to achieve the cutter layout.

In some embodiments, the cutter layout may be designed having regard to a number of considerations relating to the performance of the drill bit, including but not limited to rate of penetration of the drill bit, drill bit stability, drill bit steerability, drill bit durability, and hydraulic performance of the drill bit, which may be dependent upon the contribution which each cutter makes to the drilling of the borehole and upon the variables listed above.

In some embodiments, the present invention may relate more specifically to cutter layouts and/or cutting profiles for fixed cutter drill bits.

In some particular embodiments, the present invention may relate to a cutter layout which is comprised of a balanced cutter pattern comprising a plurality of balanced cutters, wherein the balanced cutter pattern extends outward from the bit axis toward the gauge diameter.

In some particular embodiments, the present invention may relate to a cutter layout which is comprised of a set of shared cutters, wherein the set of shared cutters is comprised of a trailing shared cutter, wherein the trailing shared cutter defines a shared cutting edge and a shared cutting path, wherein the set of shared cutters is further comprised of a leading shared cutter, wherein the leading shared cutter defines a leading cutting edge and a leading cutting path, wherein the leading cutting edge is shorter than the shared cutting edge, wherein the leading cutting path is smaller than the shared cutting path, and wherein the leading shared cutter is positioned relative to the trailing shared cutter so that the leading cutting edge superimposes the shared cutting edge as a segment of the shared cutting edge and so that the leading cutting path is completely contained within the trailing cutting path.

In some embodiments, the present invention may relate more specifically to features which facilitate connecting the drill bit with the drill string and/or disconnecting the drill bit from the drill string.

In some particular embodiments, the present invention may relate to the blades defining a pair of makeup surfaces for facilitating connecting the drill bit with the drill string and/or the blades defining a pair of breaker surfaces for facilitating disconnecting the drill bit from the drill string.

In a first particular aspect, the invention is a fixed cutter drill bit having a bit axis and a gauge diameter, the drill bit comprising:

(a) a bit body, the bit body having a proximal end adapted for connecting with a drill string, a distal end, and a plurality of blades extending from the distal end toward the proximal end, wherein the blades define a cutting profile between the bit axis and the gauge diameter; and (b) a plurality of cutters attached to the blades, wherein the cutters are distributed on the blades in a cutter layout along the cutting profile;

wherein the cutter layout is comprised of a balanced cutter pattern comprising a plurality of balanced cutters, wherein the balanced cutter pattern extends outward from the bit axis toward the gauge diameter, wherein the balanced cutter pattern has a balanced cutter diameter, wherein the center of the balanced cutter diameter coincides with the bit axis, and wherein the balanced cutter diameter is less than or equal to about 50 percent of the gauge diameter.

The balanced cutter pattern is balanced because the plurality of balanced cutters are arranged substantially symmetrically about the bit axis within the balanced cutter pattern.

The balanced cutter pattern may be comprised of one or more sets of balanced cutters, wherein each of the sets of balanced cutters is arranged substantially symmetrically about the bit axis within the balanced cutter pattern. Each set of balanced cutters is comprised of two or more balanced cutters.

In some embodiments, the plurality of balanced cutters may be comprised of a first set of balanced cutters, wherein the first set of balanced cutters is comprised of a first plurality of balanced cutters, wherein each of the first plurality of balanced cutters is positioned at a first radial distance from the bit axis, and wherein the first plurality of balanced cutters is equally spaced apart circumferentially about the bit axis. The first radial distance is a centerline of the radial position of each of the first plurality of balanced cutters.

In some embodiments, the plurality of balanced cutters may be comprised of a second set of balanced cutters, wherein the second set of balanced cutters is comprised of a second plurality of balanced cutters, wherein each of the second plurality of balanced cutters is positioned at a second radial distance from the bit axis, and wherein the second plurality of balanced cutters is equally spaced apart circumferentially about the bit axis. The second radial distance is a centerline of the radial position of each of the second plurality of balanced cutters.

In some embodiments, the plurality of balanced cutters may be comprised of more than two sets of balanced cutters.

In some embodiments, each of the balanced cutters in a set of balanced cutters may present a substantially identical bearing surface to the bottom of the borehole so that a bearing area of a set of balanced cutters is arranged substantially symmetrically about the bit axis. In some embodiments, each of the balanced cutters in a set of balanced cutters may have a substantially identical size and/or shape. In some embodiments, each of the balanced cutters in a set of balanced cutters may be positioned so that they have a substantially identical siderake, a substantially identical backrake and/or a substantially identical exposure. In some embodiments, each of the balanced cutters in a set of balanced cutters may be positioned so that they provide substantially no cutter offset relative to each other (i.e., so that their cutting paths completely overlap radially).

A set of balanced cutters may be comprised of as many balanced cutters as may be accommodated by the bit body. In some embodiments, a set of balanced cutters may be comprised of two balanced cutters which are spaced apart by about 180 degrees about the bit axis. In some embodiments, a set of balanced cutters may be comprised of three balanced cutters which are spaced apart by about 120 degrees about the bit axis. In some embodiments, a set of balanced cutters may be comprised of four balanced cutters which are spaced apart by about 90 degrees about the bit axis.

A purpose of the balanced cutter pattern is to provide symmetry and stability of the drill bit at and/or adjacent to the bit axis. In some embodiments, the balanced cutter diameter may be minimized in order to achieve the benefits of the invention without unduly compromising the performance of the drill bit. In some embodiments, the balanced cutter diameter may be less than or equal to about 40 percent of the gauge diameter. In some embodiments, the balanced cutter diameter may be less than or equal to about 30 percent of the gauge diameter.

In some embodiments, the distal end of the bit body may define a cone recess having a cone recess diameter. The center of the cone recess diameter may coincide with the bit axis. In such embodiments, the balanced cutter diameter may be less than or equal to the cone recess diameter so that the balanced cutter pattern is located within the cone recess.

In a second particular aspect, the invention is a fixed cutter drill bit having a bit axis and a gauge diameter, the drill bit comprising:

(a) a bit body, the bit body having a proximal end adapted for connecting with a drill string, a distal end, and a plurality of blades extending from the distal end toward the proximal end, wherein the blades define a cutting profile between the bit axis and the gauge diameter; and (b) a plurality of cutters attached to the blades, wherein the cutters are distributed on the blades in a cutter layout along the cutting profile;

wherein the cutter layout is comprised of a set of shared cutters, wherein the set of shared cutters is comprised of a trailing shared cutter, wherein the trailing shared cutter defines a shared cutting edge and a shared cutting path, wherein the set of shared cutters is further comprised of a leading shared cutter, wherein the leading shared cutter defines a leading cutting edge and a leading cutting path, wherein the leading cutting edge is shorter than the shared cutting edge, wherein the leading cutting path is smaller than the shared cutting path, and wherein the leading shared cutter is positioned relative to the trailing shared cutter so that the leading cutting edge superimposes the shared cutting edge as a segment of the shared cutting edge and so that the leading cutting path is completely contained within the shared cutting path.

In some embodiments, the cutter layout may be further comprised of a plurality of sets of shared cutters, wherein each set of shared cutters is comprised of a trailing shared cutter, wherein the trailing shared cutter defines a shared cutting edge and a shared cutting path, wherein each set of shared cutters is further comprised of a leading shared cutter, wherein the leading shared cutter defines a leading cutting edge and a leading cutting path, wherein the leading cutting edge is shorter than the shared cutting edge, wherein the leading cutting path is smaller than the shared cutting path, and wherein the leading shared cutter is positioned relative to the trailing shared cutter so that the leading cutting edge superimposes the shared cutting edge as a segment of the shared cutting edge and so that the leading cutting path is completely contained within the shared cutting path.

The "cutting edge" of a cutter is the peripheral edge of the portion of the cutting face of the cutting element of the cutter which exhibits an exposure to the borehole. The cutting edge of a cutter may have any shape, depending upon the shape and exposure of the cutting element. For example, if the cutting face of the cutting element is round, the cutting edge of the cutter may be arc-shaped. The cutting edge of a cutter is typically provided with a chamfer to improve the durability and impact resistance of the cutter.

A purpose of the sets of shared cutters is for the trailing shared cutter to define a shared cutting edge and a shared cutting path which are shared amongst the shared cutters as the drill bit rotates.

In some embodiments, the shared cutting edge may be shared substantially equally amongst the cutters in a set of shared cutters. In some embodiments, the length of the leading cutting edge may be about 50 percent of the length of the shared cutting edge.

In some embodiments, the trailing shared cutter may have a trailing cutter size and a trailing cutter shape, the leading shared cutter may have a nominal leading cutter size and a nominal leading cutter shape, the nominal leading cutter size may be substantially equal to the trailing cutter size, and the nominal leading cutter shape may be substantially identical to the trailing cutter shape, so that the leading shared cutter is comprised of a truncated version of the trailing shared cutter.

The leading shared cutter may be truncated relative to the trailing shared cutter in any suitable manner. In some embodiments, the leading shared cutter may initially be constructed to be substantially identical to the trailing shared cutter (so that the nominal leading cutter size is substantially equal to the trailing cutter size and so that the nominal leading cutter shape is substantially identical to the trailing cutter shape) and may subsequently be modified such as by cutting or trimming. In some embodiments, the leading shared cutter may initially be constructed as a truncated version of the trailing shared cutter.

In some embodiments, each of the shared cutters in a set of shared cutters may be positioned so that they have a substantially identical siderake and/or a substantially identical backrake.

In some embodiments, each of the sets of shared cutters may be positioned at a shared cutter radius. The shared cutter radius is a centerline of the radial position of the set of shared cutters relative to the bit axis. The shared cutter radius may be located at any position between the bit axis and the gauge diameter.

In some embodiments, the shared cutter radius may be substantially equal amongst some or all of the sets of shared cutters. In some embodiments, the shared cutter radius may be different amongst some or all of the sets of shared cutters.

The benefits of using shared cutters may be greater where the shared cutters are positioned toward the gauge diameter of the drill bit, because the amount of work which is typically performed by cutters (and thus the heat which is generated by cutters) toward the gauge diameter of the drill bit is greater than the amount of work which is typically performed (and thus the heat which is generated) by cutters which are nearer to the bit axis. Excessive heat generated by cutters may result in degradation and/or failure of the cutters.

In some embodiments, the shared cutter radius may be closer to the gauge diameter than to the bit axis. In some embodiments, the shared cutter radius may be adjacent to the gauge diameter.

In some embodiments, a set of shared cutters may be comprised of a trailing shared cutter and a plurality of leading shared cutters.

A single set of shared cutters may be located on one blade or on more than one blade. A plurality of sets of shared cutters may be located on one blade. A plurality of sets of shared cutters may be located on a plurality of blades. In some embodiments, at least one set of shared cutters may be located on each of the blades.

In a third particular aspect, the invention is a fixed cutter drill bit having a bit axis and a gauge diameter, the drill bit comprising:

(a) a bit body, the bit body having a proximal end adapted for connecting with a drill string, a distal end, and a plurality of blades extending from the distal end toward the proximal end, wherein the blades define a cutting profile between the bit axis and the gauge diameter; and (b) a plurality of cutters attached to the blades, wherein the cutters are distributed on the blades in a cutter layout along the cutting profile;

wherein the blades define a pair of makeup surfaces for facilitating connecting the drill bit with the drill string and/or wherein the blades define a pair of breaker surfaces for facilitating disconnecting the drill bit from the drill string.

Providing the makeup surfaces and/or the breaker surfaces on the blades may facilitate a shorter overall length of the drill bit in comparison with conventional drill bits in which the makeup surfaces and/or breaker surfaces may be provided on a shank section of the drill bit adjacent to the proximal end of the drill bit.

In some embodiments, the blades may define both a pair of makeup surfaces for facilitating connecting the drill bit with the drill string and a pair of breaker surfaces for facilitating disconnecting the drill bit from the drill string.

In some embodiments, the blades may define more than a pair of makeup surfaces and/or more than a pair of breaker surfaces.

In some embodiments, the makeup surfaces and/or the breaker surfaces may be located in a plane which intersects the bit axis so that the drill bit may be connected with and/or disconnected from the drill string by applying pure torsion to the drill bit.

In some embodiments, the drill bit may be further comprised of a breaker upset located between the proximal end of the bit body and the makeup surfaces and/or between the proximal end of the bit body and the breaker surfaces, wherein the breaker upset is adapted to engage with a device for supporting the drill bit when the drill bit is being connected with or disconnected from the drill string.

In some embodiments, the breaker upset may be comprised of a discontinuity on the bit body which provides an upset surface for supporting the drill bit. In some embodiments, the upset surface may extend around the circumference of the bit body. In some embodiments, the upset surface is located radially between the gauge diameter and the bit axis so that the upset surface does not interfere with the gauge diameter.

The breaker upset may be associated with the bit body in any suitable manner. In some embodiments, the breaker upset may be defined by the bit body. In some embodiments, the breaker upset may be comprised of a discontinuity which is defined by the bit body and which provides an upset surface for supporting the drill bit.

BRIEF DESCRIPTION OF DRAWINGS

Embodiments of the invention will now be described with reference to the accompanying drawings, in which:

FIG. 5 is a detail drawing of a balanced cutter pattern in the embodiment of the drill bit depicted in FIG. 1.

FIG. 6 is a schematic view of bearing surfaces presented to a bottom of a borehole by a set of balanced cutters in the embodiment of the drill bit depicted in FIG. 1.

FIG. 7 is a schematic representation of the cutting faces and the cutting edges presented to a bottom of a borehole by a set of shared cutters in the embodiment of the drill bit depicted in FIG. 1.

FIG. 8 is a detail drawing of a set of shared cutters in the embodiment of the drill bit depicted in FIG. 1.

FIG. 9 is an isolated view of a leading shared cutter in a set of shared cutters in the embodiment of the drill bit depicted in FIG. 1.

DETAILED DESCRIPTION

The present invention relates to features of a fixed cutter drill bit.

Figure 1:
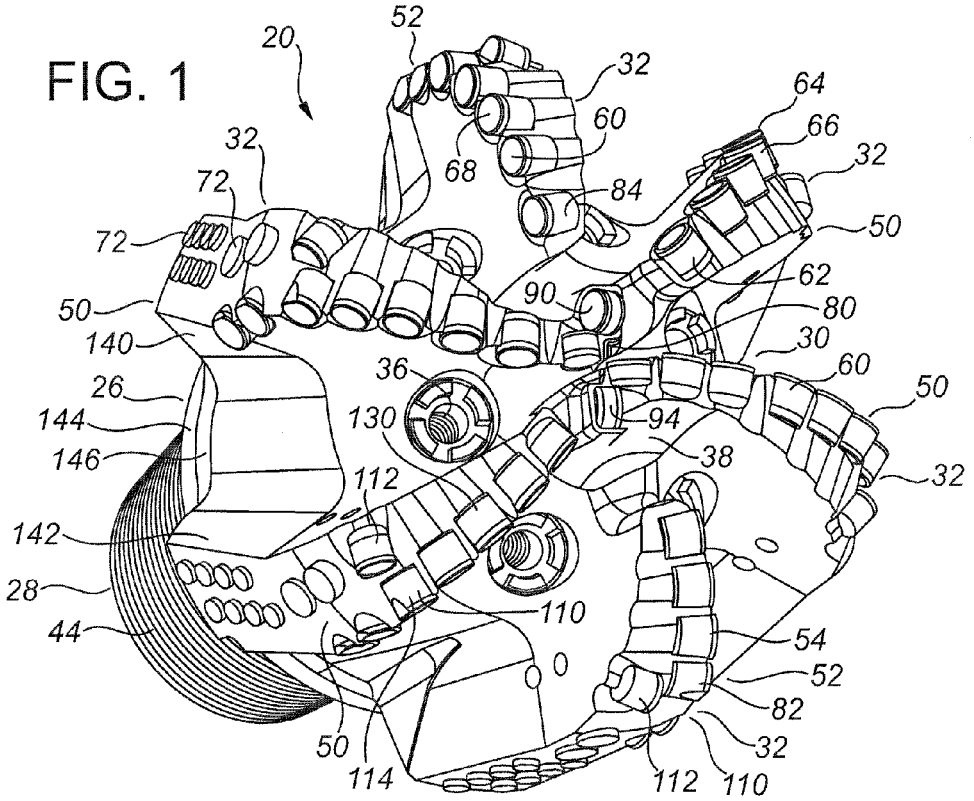
FIG. 1 is a pictorial view of the distal end of a drill bit according to an embodiment of the invention.
Figure 2:
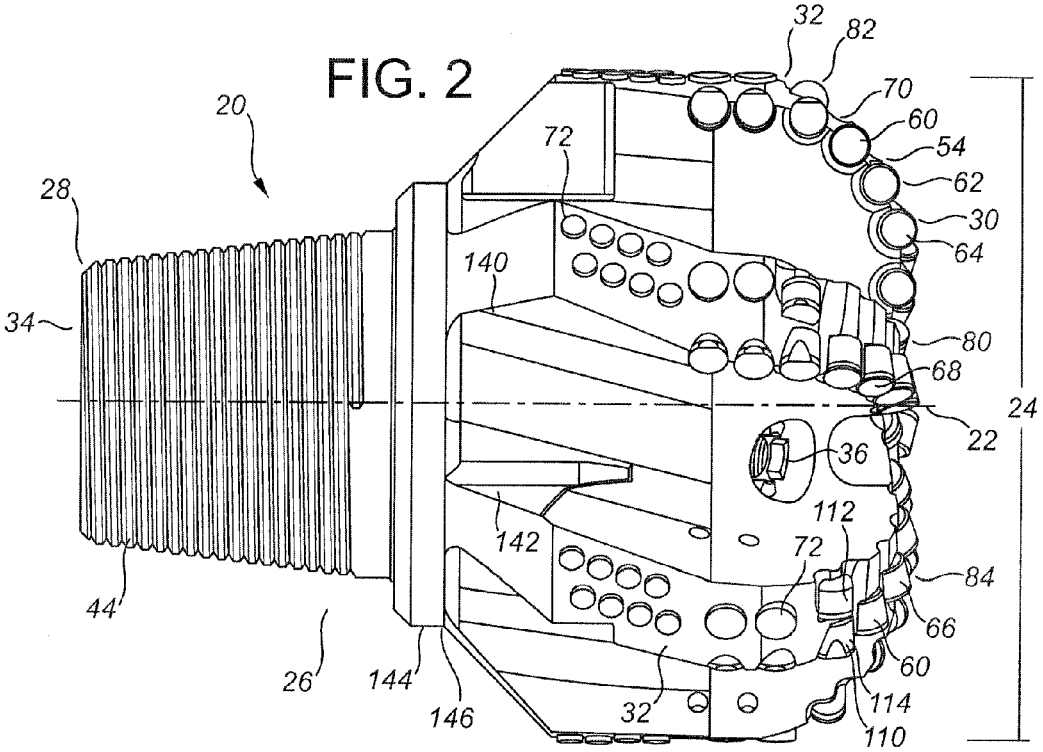
FIG. 2 is a side view of the embodiment of the drill bit depicted in FIG. 1.
Figure 3:
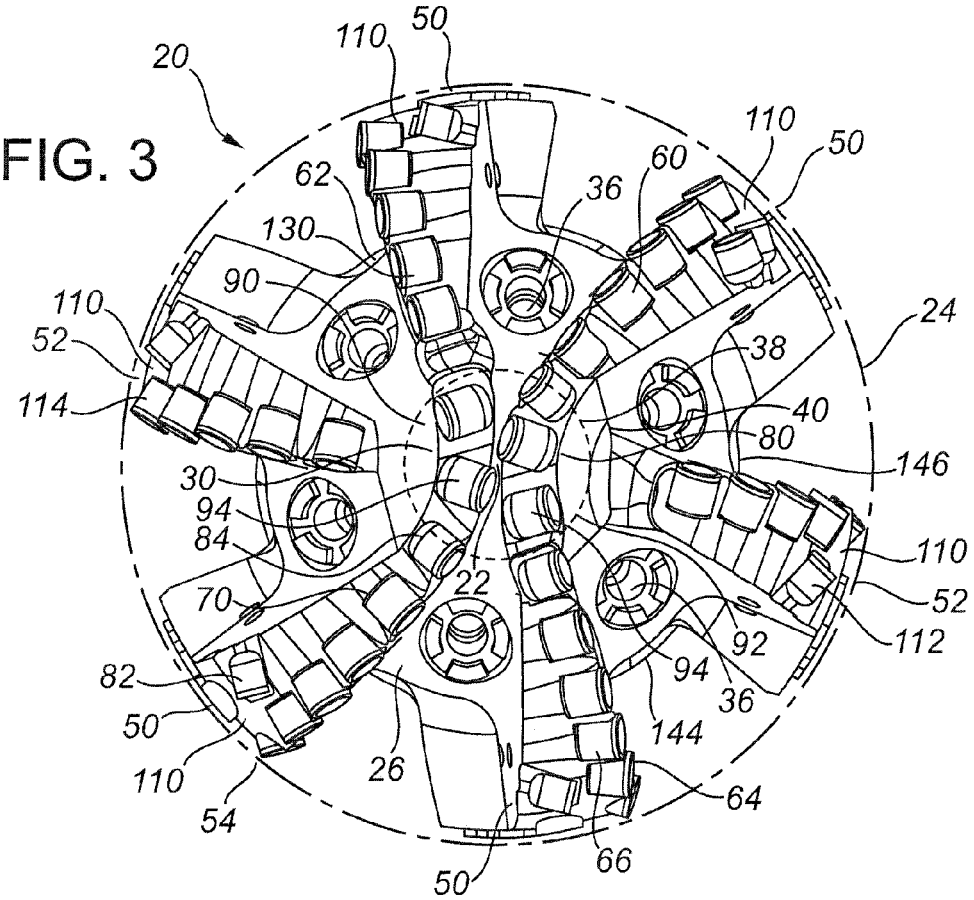
FIG. 3 is an end view of the distal end of the embodiment of the drill bit depicted in FIG. 1.
Figure 4:
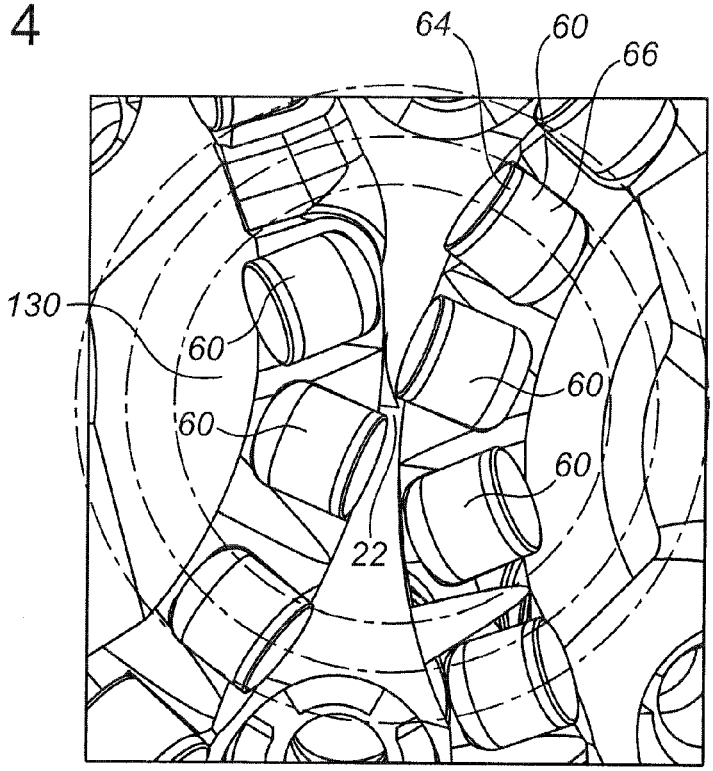
FIG. 4 is a detail drawing of an arrangement of cutters adjacent to the bit axis in a prior art drill bit.
Figure 10:
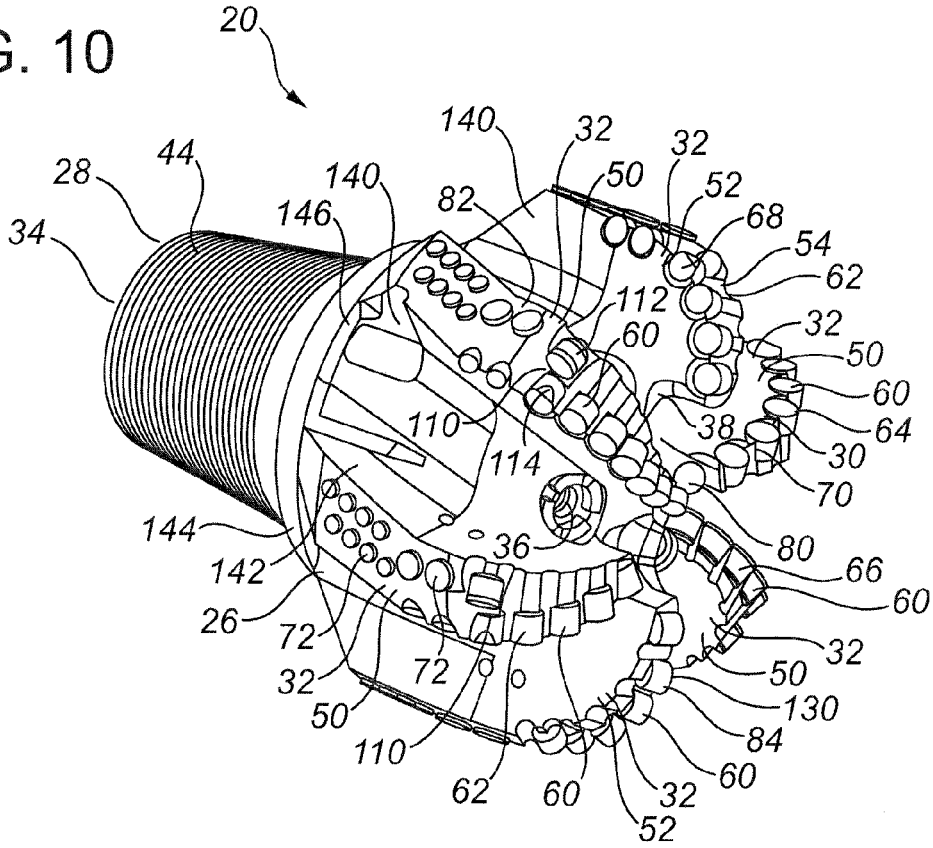
FIG. 10 is a pictorial view of the embodiment of the drill bit depicted in FIG. 1, showing a makeup surface, a breaker surface and the breaker upset.

An embodiment of a fixed cutter drill bit including embodiments of features of the invention is depicted in FIGS. 1-3 and in FIGS. 5-11. Features of a prior art fixed cutter drill bit are depicted in FIG. 4.

Referring to FIGS. 1-3 and 5-11, a fixed cutter drill bit (20) has a bit axis (22) and a gauge diameter (24).

The drill bit (20) is comprised of a bit body (26). The bit body (26) has a proximal end (28) which is adapted for connecting with a drill string (not shown), a distal end (30) and a plurality of blades (32). The bit body (26) defines a bit bore (34) which extends through the bit body (26) from the proximal end (28) and a plurality of nozzles (36) adjacent to the distal end (30) which communicate with the bit bore (34) to provide a path for a drilling fluid (not shown) to be passed through the drill string and the drill bit (20). The bit body (26) also defines a cone recess (38) having a cone recess diameter (40). The center of the cone recess diameter (40) coincides with the bit axis (22).

In the embodiment of the invention depicted in the Figures, the bit body (26) may be constructed of steel and the bit body (26) may be milled as one piece from a single block of steel. Alternatively, the bit body (26) may be constructed from a plurality of components which are subsequently connected together.

In the embodiment of the invention depicted in the Figures, the proximal end (28) of the bit body (26) is comprised of a threaded pin connector (44).

In the embodiment of the invention depicted in the Figures, bit body (26) is comprised of six blades (32) which extend as spirals from the distal end (30) of the bit body (26) toward the proximal end of the bit body (26). Four of the blades (32) are primary blades (50) which extend radially to the bit axis (22) and two of the blades (32) are secondary blades (52) which do not extend radially to the bit axis (22).

The blades (32) define a cutting profile (54) which extends radially between the bit axis (22) and the gauge diameter (24).

A plurality of cutters (60) are attached to the blades (32). The cutters (60) are distributed on the blades (32) in a cutter layout (62) along the cutting profile (54).

The cutters (60) are comprised of cutter elements (64) and substrates (66). The cutter elements (64) are affixed to the substrates (66).

In the embodiment of the invention depicted in the Figures, the cutter elements (64) may be constructed of polycrystalline diamond compact (PDC) or any other suitable material. In the embodiment depicted in the Figures, the cutter elements (64) are disc or cylinder shaped and comprise substantially flat and circular cutting faces (68).

In the embodiment of the invention depicted in the Figures, the substrates (66) may be constructed of tungsten carbide or any other suitable material.

The bit body (26) defines cutter pockets (70) along the blades (32). The cutters (60) are received in the cutter pockets (70) for attachment to the blades (32). In the embodiment depicted in the Figures, the cutters (60) may be attached to the blades (32) by brazing the substrates (66) into the cutter pockets (70).

In addition to the cutters (60) which are provided in the cutter layout (62), a plurality of gauge cutters (72) are located on each of the blades (32) between the proximal end (28) and the distal end (30) of the bit body (26). As depicted in the Figures, the gauge cutters (72) include active gauge "trimmer" cutters and passive gauge or gauge pad cutters.

The cutter layout (62) defines exposures, siderake angles, backrake angles, cutting edges and cutting paths for individual cutters (60) in the cutter layout (62). The cutter layout (62) also defines effective cutting edges and effective cutting paths for all of the cutters (60) in the cutter layout (62), having regard to cutter offsets and relative exposures of the cutters (60).

Referring to FIG. 3, the cutter layout (62) defines three cutter regions radially between the bit axis (22) and the gauge diameter (24). A central cutter region (80) extends radially outward from the bit axis (22) toward the gauge diameter (24). A peripheral cutter region (82) is located adjacent to the gauge diameter (24). An intermediate cutter region (84) is located between the central cutter region (80) and the peripheral cutter region (82).

Referring to FIG. 5, in the central cutter region (80) the cutter layout (62) is comprised of a balanced cutter pattern (90) which has a balanced cutter diameter (92). The balanced cutter pattern (90) is comprised of a plurality of balanced cutters (94).

In the embodiment of the invention depicted in the Figures, the balanced cutter diameter (92) is less than or equal to about 30 percent of the gauge diameter (24). In the embodiment depicted in the Figures, the balanced cutter diameter (92) is less than or equal to the cone recess diameter (40) so that the balanced cutter pattern is located within the cone recess (38).

In the embodiment of the invention depicted in the Figures, the plurality of balanced cutters (94) is comprised of a first set of balanced cutters (96) and a second set of balanced cutters (98).

The first set of balanced cutters (96) is comprised of a two balanced cutters as a first plurality of balanced cutters. The two balanced cutters in the first plurality of balanced cutters are arranged substantially symmetrically about the bit axis (22) within the balanced cutter pattern (90). More particularly, the two balanced cutters in the first plurality of balanced cutters are positioned at a first radial distance (100) from the bit axis (22), and are equally spaced apart circumferentially about the bit axis (22) so that they are separated by about 180 degrees. In the embodiment depicted in the Figures, the first radial distance (100) is about 0.64 inches (about 1.63 centimeters).

In the embodiment of the invention depicted in the Figures, the two balanced cutters in the first plurality of balanced cutters have a substantially identical size and/or shape, are positioned so that they have a substantially identical siderake, a substantially identical backrake, and a substantially identical exposure, and are positioned so that they provide substantially no cutter offset relative to each other. This configuration provides that the radial and tangential forces which act on the cutters (60) are substantially balanced.

The second set of balanced cutters (98) is comprised of a two balanced cutters as a second plurality of balanced cutters. The two balanced cutters in the second plurality of balanced cutters are arranged substantially symmetrically about the bit axis (22) within the balanced cutter pattern (90). More particularly, the two balanced cutters in the second plurality of balanced cutters are positioned at a second radial distance (102) from the bit axis (22), and are equally spaced apart circumferentially about the bit axis (22) so that they are separated by about 180 degrees. In the embodiment depicted in the Figures, the second radial distance (102) is about 1.4 inches (about 3.56 centimeters).

In the embodiment of the invention depicted in the Figures, the two balanced cutters in the second plurality of balanced cutters have a substantially identical size and/or shape, are positioned so that they have a substantially identical siderake, a substantially identical backrake, and a substantially identical exposure, and are positioned so that they provide substantially no cutter offset relative to each other.

The balanced cutters in each of the sets of balanced cutters (96,98) present balanced bearing surfaces to the bottom of the borehole when the drill bit (20) is in use. FIG. 6 is a schematic view depicting bearing surfaces (104) which may be presented to a bottom of a borehole by one of the sets of balanced cutters (96,98). The bearing surfaces (104) together provide a bearing area for a set of balanced cutters (96,98). As depicted in FIG. 6, the bearing surfaces (104) are substantially identical, with the result that the bearing area for a set of balanced cutters (96,98) is arranged substantially symmetrically about the bit axis (22). The balanced bearing surfaces and symmetrical bearing area may assist in mitigating the effects of fluctuations in weight on bit and resulting erratic torque response of the drill bit (20) and/or of a drilling motor (not shown) which may be connected with the drill bit (20).

The configuration of the cutter layout (62) in the central cutter region (80) according to the invention may be contrasted with the configuration of a prior art cutter layout as depicted in FIG. 4. In FIG. 4, no balanced cutter pattern (90) is provided. Instead, the cutters (60) in the central cutter region (80) are arranged so that each of the cutters (60) is at a different radial distance from the bit axis (22), with the result that the cutters (60) provide a cutter offset relative to each other.

The prior art cutter layout depicted in FIG. 4 does not provide the substantial symmetry and/or balancing which is achieved by the configuration of the cutter layout (62) in the central cutter region (80) according to the invention.

The balanced cutter pattern (90) facilitates the balancing of forces between the drill bit (20) and the bottom of a borehole and may assist in increasing the lateral stability of the drill bit (20). However, as a trade-off the inclusion of the balanced cutter pattern (90) may result in a somewhat reduced rate of penetration and a somewhat reduced depth of cut of the drill bit (20). As a result, in the embodiment of the invention depicted in the Figures, the balanced cutter pattern (90) is centralized at the bit axis (22) and the balanced cutter diameter (92) is relatively small in comparison with the gauge diameter (24).

Referring to FIG. 3, in the peripheral cutter region (82) the cutter layout (62) is comprised of a plurality of sets of shared cutters (110). As depicted in FIG. 5, one set of shared cutters (110) is attached to each of the blades (32).

Referring to FIGS. 1-3 and FIGS. 7-9, each set of shared cutters (110) is comprised of a trailing shared cutter (112) and a leading shared cutter (114). The trailing shared cutter (112) defines a shared cutting edge (116) and a shared cutting path (118). The leading shared cutter (114) defines a leading cutting edge (120) and a leading cutting path (122). The cutting edges (116,120) are provided with 45 degree chamfers to improve the durability and impact resistance of the cutters (112,114). In the embodiment of the invention depicted in the Figures, the size of the chamfers may be between about 0.01 inches (about 0.025 centimeters) and about 0.02 inches (about 0.05 centimeters).

Referring to FIG. 7, the leading cutting edge (120) is shorter than the shared cutting edge (116) and superimposes the shared cutting edge (116) as a segment of the shared cutting edge (116) so that the shared cutting edge (116) is effectively shared between the trailing shared cutter (112) and the leading shared cutter (114). More particularly, in the embodiment of the invention depicted in the Figures, the length of the leading cutting edge (120) is about 50 percent of the length of the shared cutting edge (116) so that the shared cutting edge (116) is shared substantially equally between the trailing shared cutter (112) and the leading shared cutter (114).

The leading cutting path (122) is smaller than the shared cutting path (118) and is completely contained within the shared cutting path (118).

In the embodiment of the invention depicted in the Figures, the trailing shared cutter (112) and the leading shared cutter (114) are positioned so that they have a substantially identical siderake and a substantially identical backrake.

In the embodiment of the invention depicted in the Figures, the leading shared cutter (114) has a nominal size which is substantially equal to the size of the trailing shared cutter (112) and the leading shared cutter (114) has a nominal shape which is substantially identical to the shape of the trailing shared cutter (112). In the embodiment of the invention depicted in the Figures, the leading shared cutter (114) is initially constructed to be substantially identical to the trailing shared cutter (112) and is subsequently modified by cutting or trimming so that the leading shared cutter (114) is a truncated version of the trailing shared cutter (112).

Each of the sets of shared cutters (110) is positioned at a shared cutter radius (124). In the embodiment of the invention depicted in the Figures, the shared cutter radius (124) is adjacent to the gauge diameter (24). More particularly, as depicted in the Figures the sets of shared cutters (110) are those cutters (60) in the cutter layout (62) which are closest to the gauge diameter (24).

The sets of shared cutters (110) provide for a sharing of the workload which would conventionally be assumed by a single cutter (60) to be shared amongst the trailing shared cutter (112) and the leading shared cutter (114). This sharing of workload may result in a reduction of wear of the individual cutters (60) in the sets of shared cutters (110) and a reduction in the heat generated by individual cutters (60) in the sets of shared cutters (110). Since the workload of cutters (60) in a fixed cutter drill bit (20) is typically greatest for cutters (60) located near the gauge diameter (24) where the radial velocity of the cutters (60) is highest, the sets of shared cutters (110) are typically most advantageously deployed adjacent to the gauge diameter (24).

The use of sets of shared cutters (110) in the invention is distinguished from the prior art practice of configuring the cutter layout (62) so that cutters (60) are spaced very closely together radially with very little cutter offset in order to reduce the workload of individual cutters (60). Providing very little cutter offset (i.e., high radial overlap) between cutters (60) may not result in a sufficient reduction in the heat which is generated by the individual cutters (60) to avoid thermal degradation of the cutters (60).

A reason for this is that it is believed that the heat generated by individual cutters (60) may be roughly proportional to the length of the effective cutting edge of the cutter which is permitted to contact the borehole. The length of the effective cutting edge of a cutter (60) for a given rate of penetration of the drill bit (20) is only weakly linked to the cutter offset. For example, decreasing the cutter offset by 50 percent decreases the length of the effective cutting edge only by approximately 25 percent, but may result in a significant reduction in the rate of penetration which can be achieved by the drill bit (20). As a result, decreasing cutter offset as a means to reduce the heat generated by individual cutters (60) may provide diminishing returns when the corresponding reduction in rate of penetration is considered.

Referring specifically to FIG. 7, the use of sets of shared cutters (110) in the invention results in a reduction in the length of the effective cutting edge of each of the cutters (60) in a set of shared cutters (110). Although the shared cutting edge (116) and the shared cutting path (118) is defined only by the trailing shared cutter (112), the trailing shared cutter (112) and the leading shared cutter (114) both contribute to providing the shared cutting edge (116) and the shared cutting path (118). As a result, the total cutting edge which is provided by a set of shared cutters (110) is equal to the shared cutting edge (116) and the total cutting path which is provided by a set of shared cutters (110) is equal to the shared cutting path (118), and the cutting efficiency of the drill bit (20) adjacent to the gauge diameter (24) can be maintained while reducing the heat generated by the individual cutters (60) in a set of shared cutters (110).

Referring to FIGS. 1-3, in the intermediate cutter region (84) the cutter layout (62) is comprised of a spiral cutter pattern (130) in which the cutters (60) partially overlap radially so that some cutter offset is provided amongst cutters (60) which are adjacent to each other in the direction of rotation of the drill bit (20).

The balanced cutter pattern (90) transitions to the spiral cutter pattern (130) between the central cutter region (80) and the intermediate cutter region (84).

If some or all of the sets of shared cutters (110) share the same shared cutter radius (124), the spiral cutter pattern (130) may transition between the intermediate cutter region (84) and the peripheral cutter region (82). If some or all of the sets of shared cutters (110) partially overlap radially so that some cutter offset is provided amongst the sets of shared cutters (110), a spiral pattern may continue into the peripheral cutter region (82). In the embodiment of the invention depicted in the Figures, some cutter offset is provided amongst the sets of shared cutters (110) so that the sets of shared cutters are configured in a spiral pattern.

The cutter regions (80,82,84) of the cutter layout (62) may be provided by a bit body (26) which is constructed in one piece. Alternatively, the bit body (26) may be constructed as a plurality of separate components, which may simplify the provision of the cutter regions (80,82,84). As one example, the bit body (26) may be constructed as an inner component which includes the central cutter region (80) and an outer component which includes the intermediate cutter region (84) and the peripheral cutter region (82). Constructing the bit body (26) from a plurality of components may provide greater flexibility in customizing and testing designs for the drill bit (20).

Referring to FIGS. 1-3 and FIGS. 10-11, the blades (32) define at least a pair of makeup surfaces (140) for facilitating connecting the drill bit (20) with a drill string and at least a pair of breaker surfaces (142) for facilitating disconnecting the drill bit (20) from the drill string. The makeup surfaces (140) and the breaker surface (142) are more particularly defined by the sides (144) of the blades (32), which provide generally flat surfaces for engaging with a device in order to apply torque to the drill bit (20). As depicted in the Figures, each side (144) of all of the blades (32) defines either a makeup surface (140) or a breaker surface (142).

In the embodiment of the invention depicted in the Figures, the makeup surfaces (140) and the breaker surfaces (142) are located in a plane which intersects the bit axis (22) so that the drill bit (20) may be connected with and/or disconnected from the drill string by applying pure torsion to the drill bit (20).

Referring to FIGS. 1-3 and FIGS. 10-11, the drill bit (20) is further comprised of a breaker upset (144) which is adapted to engage with a device for supporting the drill bit (20) when the drill bit (20) is being connected with or disconnected from a drill string. The breaker upset (144) is located between the proximal end (28) of the bit body (26) and the makeup surfaces (140) and between the proximal end (28) of the bit body (26) and the breaker surfaces (142).

In the embodiment of the invention depicted in the Figures, the breaker upset (144) is comprised of a discontinuity which is defined by the bit body (26) and which provides an upset surface (146) which extends around the circumference of the bit body (26), for supporting the drill bit (20). The upset surface (146) is located radially between the gauge diameter (24) and the bit axis (22) so that the upset surface (146) does not interfere with the gauge diameter (24).

The upset surface (146) has an outer diameter or dimension which is equal to the diameter defined by the API bit bevel size.

The upset surface (146) has an inner diameter or dimension which is substantially the same for a given API rotary shoulder connection size. For example, drill bits (20) which incorporate a 4.5 inch (11.4 centimeters) regular connection may provide a minor diameter or dimension of the upset surface (146) of 5.5 inches (14 centimeters). This approach to configuring the breaker upset (144) and the upset surface (146) simplifies the design of the drill bit (20) and facilitates wider universality of devices which are used to apply torque to the drill bit (20) and/or to support the drill bit (20) while it is being connected with or disconnected from the drill string.

The object of the breaker upset (144) and the upset surface (146) is to prevent the drill bit (20) from falling through the master bushing (not shown) of the drill rig (not shown) when the drill bit (20) is not connected with the drill string.

Figure 11:
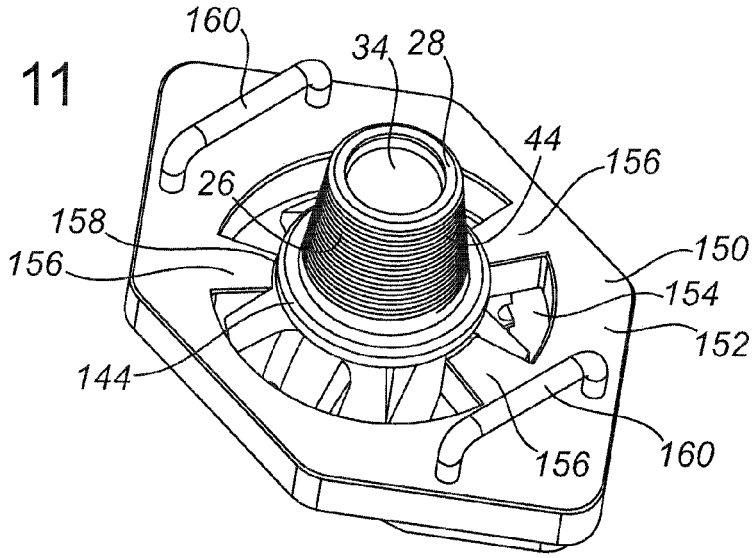
FIG. 11 is a schematic drawing of the embodiment of the drill bit depicted in FIG. 1 and a breaker plate tool for use in connecting the drill bit with a drill string and disconnecting the drill bit from the drill string.

Referring to FIG. 11, there is provided a schematic drawing of a breaker plate tool (150) which may be used in association with the embodiment of the invention depicted in FIGS. 1-3 and FIGS. 5-11 in order to connect the drill bit with a drill string and in order to disconnect the drill bit from a drill string.

The breaker plate tool (150) is comprised of a plate (152) which defines an aperture (154). A plurality of lugs (156) extend toward the center of the aperture (154). The lugs (156) define a bore (158) in the center of the aperture (154) for receiving the proximal end (28) of the bit body (26).

The lugs (156) are sized to fit between adjacent blades (32) on the bit body (26). The lugs (156) are configured to engage with the makeup surfaces (140) in order to apply torque to the drill bit (20) to connect the drill bit (20) with a drill string, to engage with the breaker surfaces (142) in order to apply torque to the drill bit (20) in order to disconnect the drill bit (20) from a drill string, and to engage with the upset surface (146) in order to support the drill bit (20) while the drill bit (20) is being connected with or disconnected from a drill string.

Handles (160) on the plate (152) facilitate the application of torque to the drill bit (20) by the breaker plate tool.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The embodiments of the invention in which an exclusive property or privilege is claimed are defined as follows:

1. A fixed cutter drill bit having a bit axis and a gauge diameter, the drill bit comprising:

a bit body, the bit body having a proximal end adapted for connecting with a drill string, a distal end, and a plurality of blades extending from the distal end toward the proximal end, wherein the blades define a cutting profile between the bit axis and the gauge diameter; and (b) a plurality of cutters attached to the blades, wherein the cutters are distributed on the blades in a cutter layout along the cutting profile;

wherein the cutter layout is comprised of a balanced cutter pattern comprising a plurality of balanced cutters, wherein the balanced cutter pattern extends outward from the bit axis toward the gauge diameter, wherein the balanced cutter pattern has a balanced cutter diameter, wherein the center of the balanced cutter diameter coincides with the bit axis, wherein the balanced cutter diameter is less than or equal to 50 percent of the gauge diameter and wherein the balanced cutter pattern extends only to the balanced cutter diameter such that the balanced cutter diameter provides a transition between the balanced cutter pattern and an intermediate cutter region wherein some cutter offset is provided amongst the cutters.

2. The drill bit as claimed in claim 1 wherein the plurality of balanced cutters is comprised of a first set of balanced cutters, wherein the first set of balanced cutters is comprised of a first plurality of balanced cutters, wherein each of the first plurality of balanced cutters is positioned at a first radial distance from the bit axis, and wherein the first plurality of balanced cutters is equally spaced apart circumferentially about the bit axis.

3. The drill bit as claimed in claim 2 wherein each of the balanced cutters of the first plurality of balanced cutters has a substantially identical size and shape.

4. The drill bit as claimed in claim 3 wherein the first plurality of balanced cutters are positioned so that they have a substantially identical siderake, a substantially identical backrake and a substantially identical exposure.

5. The drill bit as claimed in claim 2 wherein the first set of balanced cutters is comprised of two balanced cutters which are spaced apart circumferentially by 180 degrees about the bit axis.

6. The drill bit as claimed in claim 2 wherein the plurality of balanced cutters is comprised of a second set of balanced cutters, wherein the second set of balanced cutters is comprised of a second plurality of balanced cutters, wherein each of the second plurality of balanced cutters is positioned at a second radial distance from the bit axis, and wherein the second plurality of balanced cutters is equally spaced circumferentially about the bit axis.

7. The drill bit as claimed in claim 6 wherein each of the balanced cutters of the second plurality of balanced cutters has a substantially identical size and shape.

8. The drill bit as claimed in claim 7 wherein the second plurality of balanced cutters are positioned so that they have a substantially identical siderake, a substantially identical backrake and a substantially identical exposure.

9. The drill bit as claimed in claim 6 wherein the second set of balanced cutters is comprised of two balanced cutters which are spaced apart circumferentially by 180 degrees about the bit axis.

10. The drill bit as claimed in claim 2 wherein the balanced cutter diameter is less than or equal to 40 percent of the gauge diameter.

11. The drill bit as claimed in claim 2 wherein the balanced cutter diameter is less than or equal to 30 percent of the gauge diameter.

12. The drill bit as claimed in claim 2 wherein the distal end of the bit body defines a cone recess having a cone recess diameter, wherein the center of the cone recess diameter coincides with the bit axis, and wherein the balanced cutter diameter is less than or equal to the cone recess diameter.

13. The drill bit as claimed in claim 1 wherein the cutter layout is further comprised of a set of shared cutters, wherein the set of shared cutters is comprised of a trailing shared cutter, wherein the trailing shared cutter defines a shared cutting edge and a shared cutting path, wherein the set of shared cutters is further comprised of a leading shared cutter, wherein the leading shared cutter defines a leading cutting edge and a leading cutting path, wherein the leading cutting edge is shorter than the shared cutting edge, wherein the leading cutting path is smaller than the shared cutting path, and wherein the leading shared cutter is positioned relative to the trailing shared cutter so that the leading cutting edge superimposes the shared cutting edge as a segment of the shared cutting edge and so that the leading cutting path is completely contained within the shared cutting path.

14. The drill bit as claimed in claim 13 wherein the trailing shared cutter and the leading shared cutter of the set of shared cutters are positioned so that they have a substantially identical siderake and a substantially identical backrake.

15. The drill bit as claimed in claim 13 wherein the set of shared cutters is positioned at a shared cutter radius and wherein the shared cutter radius is closer to the gauge diameter than to the bit axis.

16. The drill bit as claimed in claim 15 wherein the shared cutter radius is adjacent to the gauge diameter.

17. The drill bit as claimed in claim 13 wherein the trailing shared cutter has a trailing cutter size and a trailing cutter shape, wherein the leading shared cutter has a nominal leading cutter size and a nominal leading cutter shape, wherein the nominal leading cutter size is equal to the trailing cutter size, wherein the nominal leading cutter shape is the same as the trailing cutter shape, and wherein the leading shared cutter is comprised of a truncated version of the trailing shared cutter.

18. The drill hit as claimed in claim 13 wherein the shared cutting edge has a length, wherein the leading cutting edge has a length, and wherein the length of the leading cutting edge is 50 percent of the length of the shared cutting edge.

19. The drill bit as claimed in claim 13 wherein the cutter layout is further comprised of a plurality of sets of shared cutters, wherein each set of shared cutters is comprised of a trailing shared cutter, wherein the trailing shared cutter defines a shared cutting edge and a shared cutting path, wherein each set of shared cutters is further comprised of a leading shared cutter, wherein the leading shared cutter defines a leading cutting edge and a leading cutting path, wherein the leading cutting edge is shorter than the shared cutting edge, wherein the leading cutting path is smaller than the shared cutting path, and wherein the leading shared cutter is positioned relative to the trailing shared cutter so that the leading cutting edge superimposes the shared cutting edge as a segment of the shared cutting edge and so that the leading cutting path is completely contained within the shared cutting path.

20. The drill bit as claimed in claim 19 wherein the trailing shared cutter and the leading shared cutter of each of the sets of shared cutters are positioned so that they have a substantially identical siderake and a substantially identical backrake.

21. The drill bit as claimed in claim 19 wherein each set of shared cutters is positioned at a shared cutter radius and wherein the shared cutter radius is closer to the gauge diameter than to the bit axis.

22. The drill bit as claimed in claim 21 wherein the shared cutter radius is adjacent to the gauge diameter.

23. The drill bit as claimed in claim 22 wherein at least one set of shared cutters is located on each of the blades.

24. The drill bit as claimed in claim 1 wherein the blades define a pair of makeup surfaces for facilitating connecting the drill bit with the drill string.

25. The drill bit as claimed in claim 24 wherein each of the makeup surfaces is in a plane which intersects the bit axis.

26. The drill bit as claimed in claim 1 wherein the blades define a pair of breaker surfaces for facilitating disconnecting the drill bit from the drill string.

27. The drill bit as claimed in claim 26 wherein each of the breaker surfaces is in a plane which intersects the bit axis.

28. The drill bit as claimed in claim 1 wherein the blades define a pair of makeup surfaces for facilitating connecting the drill bit with the drill string and wherein the blades define a pair of breaker surfaces fix facilitating disconnecting the drill bit from the drill string.

29. The drill bit as claimed in claim 28 wherein each of the makeup surfaces is in a plane which intersects the bit axis.

30. The drill bit as claimed in claim 28 wherein each of the breaker surfaces is in a plane which intersects the bit axis.

31. The drill bit as claimed in claim 29 wherein each of the breaker surfaces is in a plane which intersects the bit axis.

32. The drill bit as claimed in claim 28, further comprising a breaker upset located between the proximal end of the bit body and the makeup surfaces and between the proximal end of the bit body and the breaker surfaces, wherein the breaker upset is adapted to engage with a device for supporting the drill bit when the drill bit is being connected with or disconnected from the drill string.

33. The drill bit as claimed in claim 32 wherein the breaker upset is defined by the bit body.

* * * * *

UNITED STATES PATENT AND TRADEMARK OFFICE

CERTIFICATE OF CORRECTION

PATENT NO. : 8,991,526 B2
APPLICATION NO. : 13/143814
DATED : March 31, 2015
INVENTOR(S) : Sean Gillis It is certified that error appears in the above-identified patent and that said Letters Patent is hereby corrected as shown below:

In the Claims

Column 16, Line 63, (Claim 1) before “a bit body” insert -- (a) --

Column 18, Line 29, (Claim 18) change “hit” to -- bit --

Column 19, Line 6, (Claim 28) change “fix” to -- for --

Signed and Sealed this
Twenty-first Day of July, 2015

Michelle K. Lee

Michelle K. Lee
*Director of the United States Patent and Trademark Office*